US006921073B2

(12) United States Patent
Chabot et al.

(10) Patent No.: US 6,921,073 B2
(45) Date of Patent: Jul. 26, 2005

(54) BINGO CARD HOLDER

(76) Inventors: Marc Chabot, 725 Welland Avenue, #19, St. Catherines, Ontario (CA), L2N 7X9; Gerald Chabot, 725 Welland Avenue, #19, St. Catherines, Ontario (CA), L2N 7X9

( * ) Notice: Subject to any disclaimer, the term of this patent is extended or adjusted under 35 U.S.C. 154(b) by 52 days.

(21) Appl. No.: 10/338,871

(22) Filed: Jan. 9, 2003

(65) Prior Publication Data

US 2004/0135315 A1 Jul. 15, 2004

(51) Int. Cl.[7] ..... A63F 3/06

(52) U.S. Cl. ..... 273/269; 273/148 A; 273/239; 24/303; 40/661.01

(58) Field of Search ..... 273/148 R, 148 A, 273/269, 239; 40/600, 124.04, 661.06, 661.01, 672, 426, 124, 904; 24/67 R, 303

(56) References Cited

U.S. PATENT DOCUMENTS

| | | | | | |
|---|---|---|---|---|---|
| 3,616,558 | A | * | 11/1971 | Jahn | 40/711 |
| 3,811,680 | A | | 5/1974 | Benesch | |
| 4,133,536 | A | | 1/1979 | Cole | |
| 4,165,878 | A | | 8/1979 | Frain | |
| 4,258,493 | A | * | 3/1981 | Kettlestrings et al. | 40/600 |
| 4,630,830 | A | | 12/1986 | Gadd | |
| 4,795,162 | A | | 1/1989 | Rhetts | |
| 5,286,025 | A | | 2/1994 | Mulyca et al. | |
| 5,307,579 | A | * | 5/1994 | Clayton et al. | 40/600 |
| 5,425,160 | A | * | 6/1995 | Krapf | 24/67 R |
| 5,456,474 | A | | 10/1995 | Geshkewich | |
| D386,324 | S | | 11/1997 | Degen | |
| D433,463 | S | | 11/2000 | Dalbo | |
| 6,364,126 | B1 | * | 4/2002 | Enriquez | 211/13.1 |
| 2002/0088158 | A1 | * | 7/2002 | Jones | 40/658 |

* cited by examiner

*Primary Examiner*—William M. Pierce
(74) *Attorney, Agent, or Firm*—Ursula McGuinness; Gowling Lafleur Henderson LLP

(57) ABSTRACT

The invention relates to an improved device for holding a plurality of bingo cards. The cards are secured in position by cooperating securing means comprising a magnetic strip and a metal strip. The magnetic attraction between the magnetic strip and the metal strip is sufficient to prevent the cards from slipping. The device is foldable and easily carried and is particularly suitable for holding four bingo cards in a row.

11 Claims, 5 Drawing Sheets

BINGO CARD HOLDER

FIELD OF THE INVENTION

The present invention relates to a compact portable device for holding a Bingo card in a fixed position.

BACKGROUND OF THE INVENTION

Bingo has long been a popular game and various devices for use in association with the game have been developed. Traditionally, Bingo was played using hand cards sufficiently rigid to facilitate repeated use. The Bingo numbers were "cancelled" by applying a chip to the card. With the advent of large scale charity Bingos and commercial Bingo establishments, it has become more common to use paper Bingo sheets which are used only once. The announced numbers are typically cancelled by the use of a special marker or "dauber".

A player often plays a plurality of Bingo cards at the same time. It has been found difficult to maintain a substantial number of cards aligned before a player. Because Bingo cards tend to be lightweight, it is necessary to secure the cards to prevent them from scattering on the table. This is often done by using tape to attach the cards to one another and prevent their moving around.

Various devices for supporting a plurality of Bingo cards have been developed. For example, U.S. Pat. No. 4,133,536 comprises a transparent acetate sheet and a backing plate. The Bingo cards are placed between the acetate sheet and the backing plate and are held in position by an adhesive coating on the back of the acetate sheet. The transparent acetate sheet has a plurality of holes corresponding to the Bingo numbers which can accommodate a dauber to mark the numbers on the card. Over time, however, the edges of the holes are likely to get marked by inaccurately placed marks, making it more difficult to readily see which numbers have been marked.

U.S. Pat. No. 4,630,830 discloses a Bingo card holder comprising a plurality of transparent pockets which each can hold a Bingo card. The upper surface of the pocket can be marked by conventional erasable markers to identify the called numbers on the cards retained in the pockets. The type of device requires cleaning between each play.

U.S. Pat. No. 5,456,474 also discloses a Bingo card holder. The holder comprises a base with perforations arranged in rows and columns whereby Bingo cards fit between the perforations. The cards are held in place by means of a re-usable adhesive layer on the base. A thin transparent cover sheet is also provided. The holder is typically a large rectangle with five rows and five columns which makes it fairly bulky to carry around.

Bingo card holders currently in use have several disadvantages. They are often expensive to manufacture, bulky to transport or wear out easily. Thus, there remains a need for an improved Bingo card holder which can be re-used multiple times and which can be easily carried in a pocket or purse.

SUMMARY OF THE INVENTION

The present invention provides an improved holder for a plurality of Bingo cards which overcomes the disadvantages of the prior art.

The Bingo card holder of the present invention comprises at least one foldable sheet of thermoplastic material incorporating three semi-rigid panels wherein said sheet may be folded along fold lines between each of the panels to provide a folded configuration. The first panel includes a magnet on one side and the third panel includes a metal strip along one edge. In the folded configuration, the sheet is folded along the fold line between the second and third panels such that the magnetic strip on the first panel and the metal strip on the third panel provide a cooperating securing means for holding a Bingo card. The thermoplastic sheet extends beyond the top of the first panel to provide a pull tab. In use, the pull tab is used to separate the magnet and metal by flipping up the first panel. A Bingo card is placed on the metal strip and then the first panel is lowered thereby trapping the Bingo card between the magent and the metal.

BRIEF DESCRIPTION OF THE DRAWINGS

Other features and advantages of the invention will be apparent from the acompanying drawings in which.

DETAILED DESCRIPTION

When playing Bingo, a player often desires to play more than one card at a time and thus is confronted with the problem of trying to keep multiple cards aligned. The present invention provides an easy-to-use answer to this problem by taking advantage of magnetic force to frictionally engage a Bingo card between magnetically attracted components.

Figure 1:
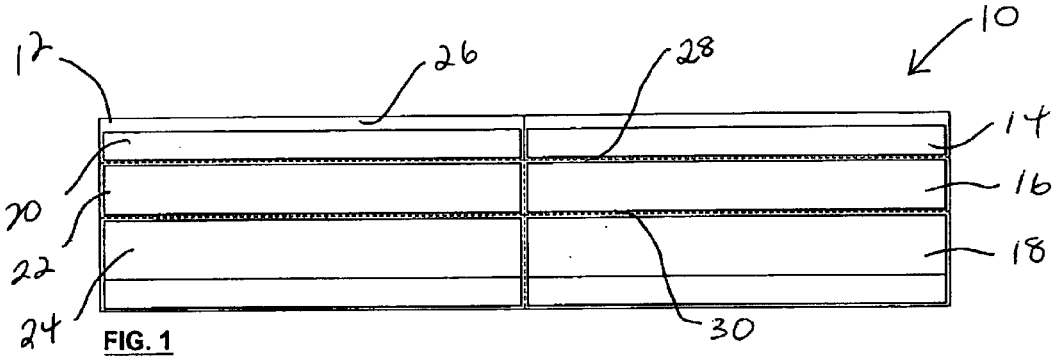
FIG. 1 is a top plan view of the holder in the unfolded configuration.
Figure 2:
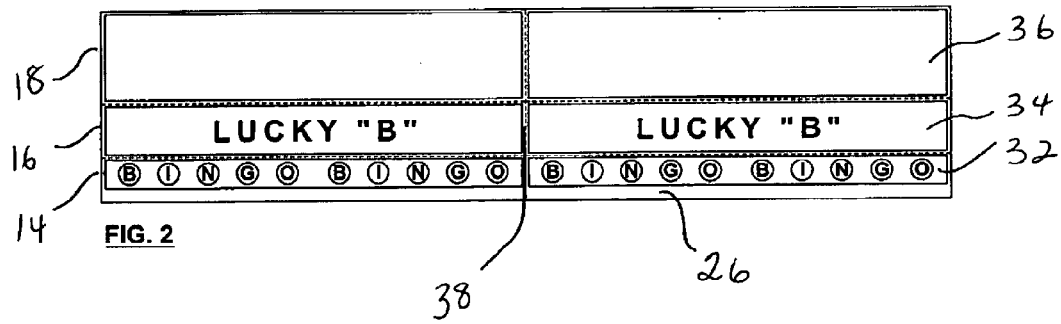
FIG. 2 is a bottom plan view of the holder in the unfolded configuration.

The Bingo card holder can be manufactured as a planar sheet as shown in FIGS. 1 and 2. FIG. 1 shows a top side of the holder and FIG. 2 shows the opposite side. Referring now to FIG. 1, the holder 10 comprises a sheet of thermoplastic material 12. The sheet 12 incorporates a first panel 14, a second panel 16 and a third panel 18 of semi-rigid material. FIG. 1 shows the top sides 20, 22, 24 of the first, second and third panel, respectively. The sheet also includes an extended region 26 of thermoplastic material. The thermoplastic material between the panels provides for fold regions. There is a first fold region 28 between the first and second panels and a second fold region 30 between the second and third panels.

FIG. 2 illustrates the view seen when the side shown in FIG. 1 is turned over. The flip sides 32, 34, 36 of the three panels 14, 16, 18 are shown, respectively. The flip side 32 of the first panel is typically printed with the letters B, I, N, G, O. The letters are spaced a predetermined distance in a horizontal direction to correspond with the spacing of the letters on a standard Bingo card. In one preferred embodiment, the flip side 34 of the second panel is printed with promotional material. Each holder is typically adapted to hold two Bingo cards. The length of the holder can be adapted to fit any size of Bingo card. Preferably a holder is adapted to hold two standard large Bingo cards or two standard small Bingo cards.

In a preferred embodiment, multiple holders are provided in tandem on a continuous sheet of thermoplastic material. FIGS. 1 and 2 show two holders with an interconnecting region of thermoplastic material which provides for a third fold region 38. It is clearly apparent that three single holder units or more could also be provided in tandem.

Figure 3:
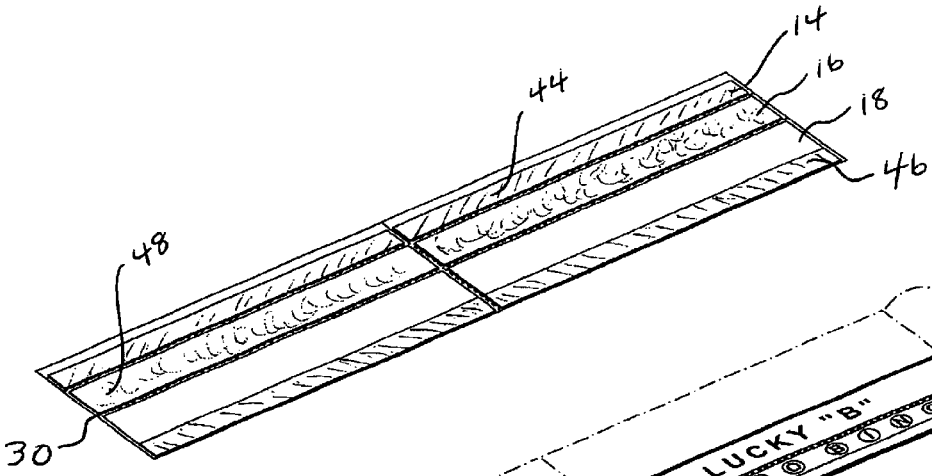
FIG. 3 is a top view of the holder with the magnet and metal strip attached.
Figure 4:
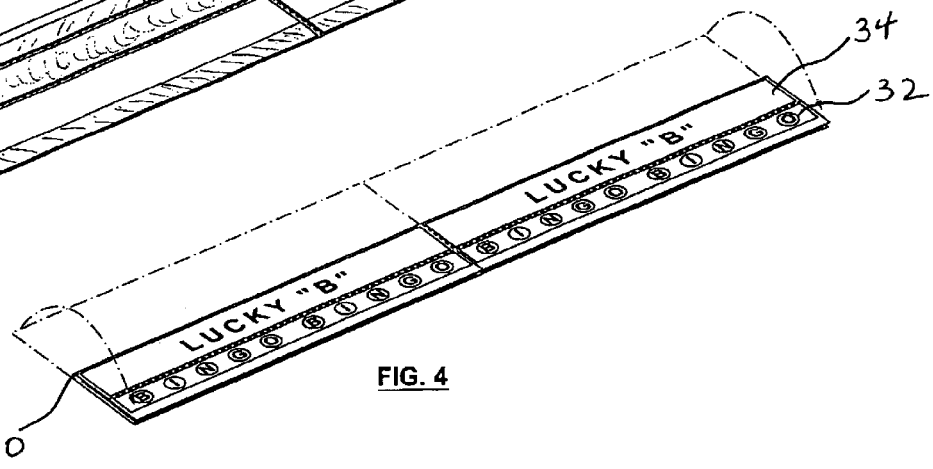
FIG. 4 illustrates how the holder is folded.

FIGS. 3 and 4 demonstrate how the holder is converted to a functional configuration. As shown in FIG. 3, the first panel 14 includes a magnetic strip 44. The magnetic strip is preferably a length of ½ inch flexible, adhesive magnet. The third panel 18 has a metal component 46. The metal component is preferably a band of ½ inch metal adhered along the outer edge of the panel. The second panel 16, the third panel 18 or both are provided with a layer of adhesive material. In a preferred embodiment, two-sided tape 48 is applied to the second panel. FIG. 4 illustrates how the holder is folded along the second fold region 30. In this configuration the second and third panels adhere to each other in the areas where adhesive material was provided. Then the magnetic strip 44 of the first panel is magnetically attracted to the metal strip 46 along the edge of the third panel. When the magnetic strip 44 and the metal strip 46 are held together due to magnetic attraction, the extended region 26 of the thermoplastic sheet extends past the interaction of the two.

Figure 5:
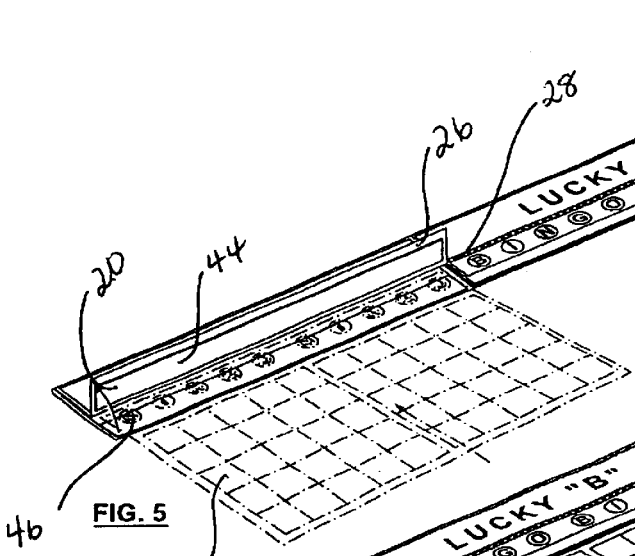
FIG. 5 illustrates the holder opened to accept a Bingo card.
Figure 6:
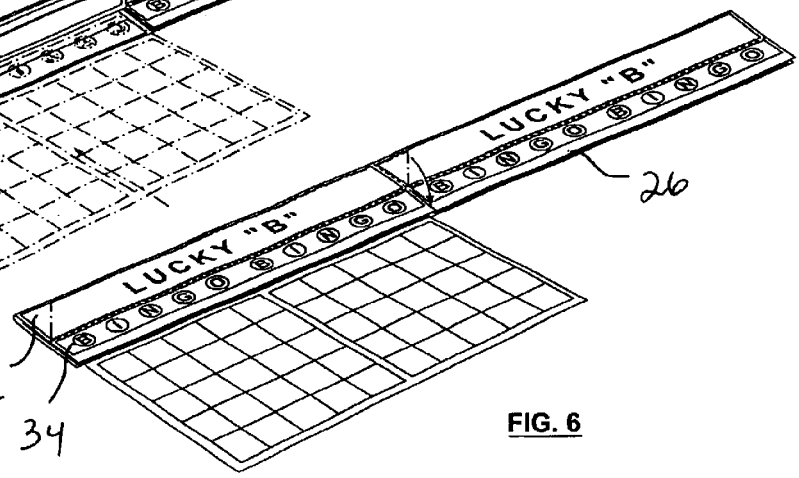
FIG. 6 illustrates the holder in the closed position gripping a Bingo card.

Referring now to FIGS. 5 and 6, the operation of the holder is illustrated. The extended region 26 of thermoplastic material can be used as a pull tab to pull the magnetic strip 44 away from the metal strip 46. The first panel 14 is thereby flipped up by creating a bend along the first fold region 28. At least one Bingo card 50 is laid on the metal strip and then the first panel is flipped closed. The magnet and the metal work together as a cooperating securing means. The magnet exerts sufficient magnetic force to draw the metal against the magnet with enough pressure such that the Bingo card is frictionally engaged between the magnet and the metal. In a preferred embodiment a dual tandem holder is provided which can hold four Bingo cards.

Figure 7:
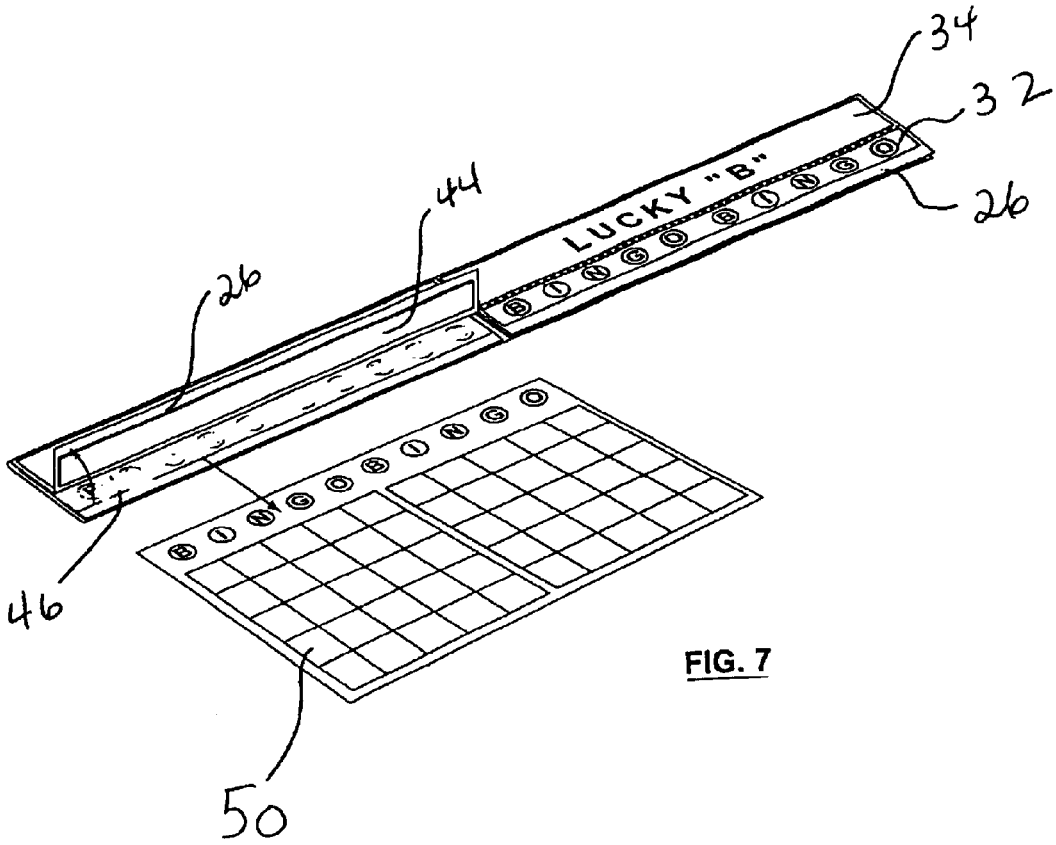
FIG. 7 illustrates how the holder is opened to remove a card.

FIG. 7 illustrates how the first panel is flipped up to release the card when play is completed. Once the first panel is lifted the magnetic hold is released and the card can be simply pulled away from the metal strip.

Figure 8:
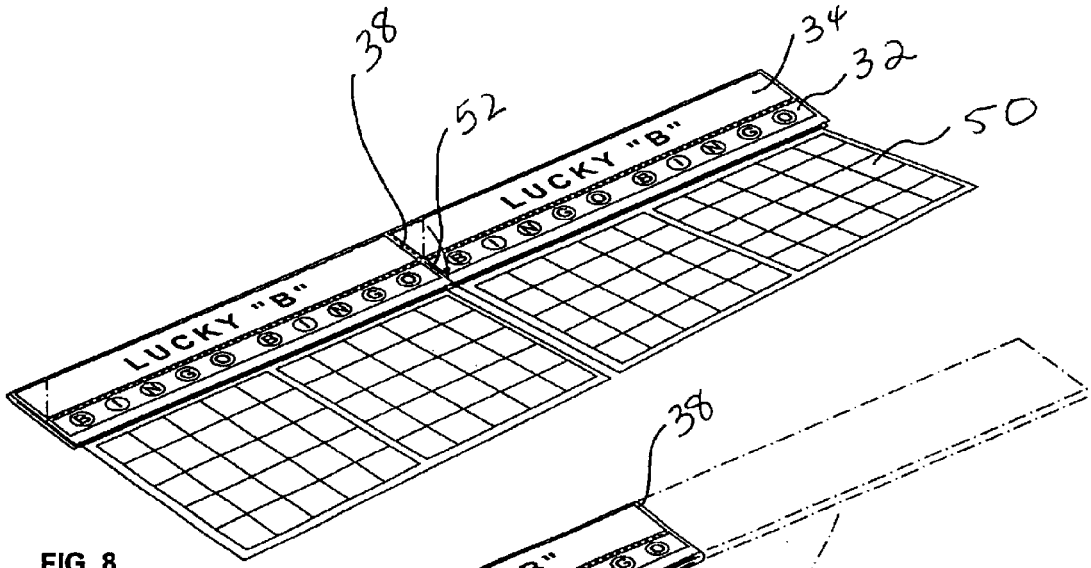
FIG. 8 illustrates a tandem Bingo card holder with four cards held in position.

FIG. 8 illustrates a preferred embodiment in which four Bingo cards are held in position by a tandem holder. A cut 52 in the sheet material allows each of the holders to be separately opened and closed. It is clearly apparent that the size of the holder can be adapted to hold Bingo cards of various dimensions. A typical dual tandem holder for "large" Bingo cards is approximately 17 inches long and 4 inches wide. A typical tandem holder for four "small" Bingo cards is approximately 13 inches long and 4 inches wide. The length of the holder can easily be adjusted to fit any size Bingo card.

Figure 9:
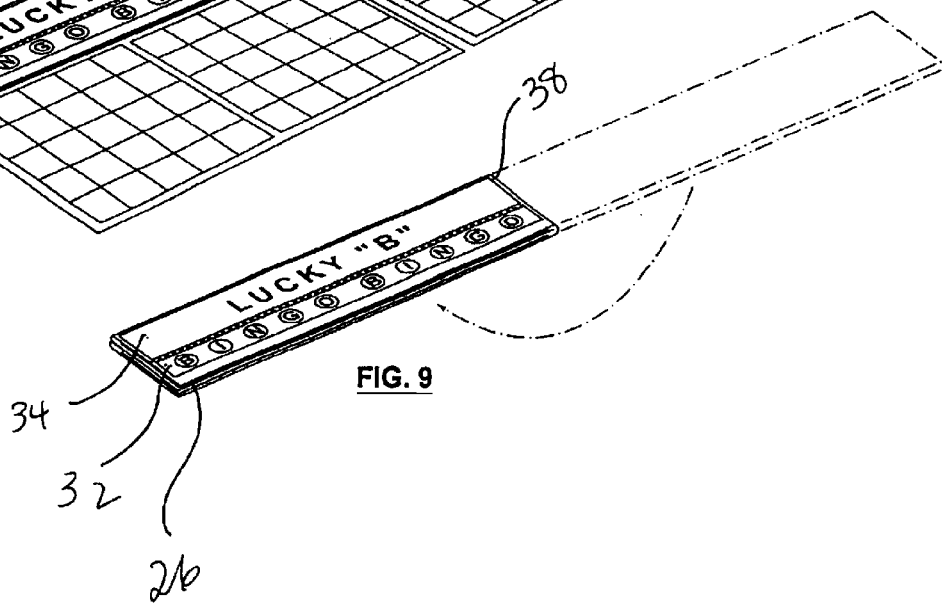
FIG. 9 illustrates a tandem card holder folded for easy transport.

FIG. 9 illustrates how a tandem holder can be easily folded along the third fold line 38 to be carried in a pocket or purse.

The present invention provides several advantages over the prior art devices. The present Bingo card holder is easy to manufacture and can be re-used many times. Markers are applied directly to the Bingo card making frequent cleaning of the holder unnecessary. In addition, the holder is lightweight and foldable making it easy to transport in a pocket or purse.

Although preferred embodiments of the invention have been described herein in detail, it will be understood by those skilled in the art that variations may be made thereto without departing from the spirit of the invention or the scope of the appended claims.

We claim:

1. A Bingo card holder comprising:

i) a first panel having a magnetic element on one surface and indicia on the opposite surface spaced to correspond to columns on a game card;

ii) a second panel adjacent to the first panel; and iii) a third panel adjacent to the second panel, said third panel having a metal element along an edge, wherein the width of the first and second panel together are substantially equal to the width of the third panel to enable the second panel to be adhered to the third panel and to enable the first and second panel to be folded to overlie the third panel, with the first panel and the second panel being coplanar, and both contacting the third panel to enable the second panel to be adhered to the third panel and to cause the magnetic element to engage the metal element.

2. The Bingo card holder of claim 1 wherein the panels comprise a thermoplastic material.

3. The Bingo card holder of claim 1 wherein the holder further comprises a pull tab for releasing the interaction between the magnetic element and the metal element.

4. The Bingo card holder of claim 1 wherein the magnetic element is a strip of flexible magnetic material adhered along the length of the first panel.

5. The Bingo card holder of claim 4 wherein the flexible magnetic material is a ½ inch strip.

6. The Bingo card holder of claim 1 wherein the metal element is a strip of ½ inch metal adhered along the outer edge of the third panel.

7. The Bingo card holder of claim 2 wherein said first, second and third panel each comprise a cardboard strip laminated between layers of the thermoplastic material of the planar sheet.

8. The Bingo card holder of claim 1 wherein the planar sheet is about 8 ¼ inches long and said first panel is about ⅝ inches wide, said second panel is about 1 inch wide and said third panel is approximately 1 ⅝ inches wide.

9. A tandem Bingo card holder comprising at least two of the card holder as defined in claim 1 attached to each other.

10. The tandem Bingo card holder of claim 9 having a length adapted to hold four Bingo cards.

11. A Bingo card holder according to claim 1 wherein the indicia of the holder comprise the letters B, I, N, G, O to enable the columns on a Bingo card to line up under each letter.

* * * * *